US005933961A

United States Patent [19]

Oakey

[11] Patent Number: 5,933,961

[45] Date of Patent: Aug. 10, 1999

[54] ELECTRIC SHAVER WITH VACUUM

[76] Inventor: Warwick L. Oakey, 10 Hindlip Close, Winyates Green, Redditch, Worcester, United Kingdom, UK B98 0QP

[21] Appl. No.: 09/070,568

[22] Filed: Apr. 30, 1998

[51] Int. Cl.[6] ..... B26B 19/44

[52] U.S. Cl. ..... 30/41; 30/41.5

[58] Field of Search ..... 30/41.5, 41, 41.6

[56] References Cited

U.S. PATENT DOCUMENTS

| | | | |
|---|---|---|---|
| 2,916,821 | 12/1959 | Witmer | 30/41.5 |
| 3,611,566 | 10/1971 | Brennan, Sr. | 30/41.5 |
| 3,905,099 | 9/1975 | Bernstom | 30/41.5 |
| 4,089,110 | 5/1978 | Rasco | 30/41.5 |
| 4,219,931 | 9/1980 | Vacilotto | 30/41.5 |
| 4,970,787 | 11/1990 | Watanabe et al. | 30/41.5 |
| 5,261,161 | 11/1993 | Lee | 30/41.5 |

FOREIGN PATENT DOCUMENTS

| | | | |
|---|---|---|---|
| 1119717 | 12/1961 | Germany | 30/41.5 |
| 1165453 | 3/1964 | Germany | 30/41.5 |
| 1553821 | 8/1973 | Germany | 30/41.5 |
| 2317721 | 10/1974 | Germany | 30/41.5 |
| 3330741 | 3/1985 | Germany | 30/41.5 |

*Primary Examiner*—M. Rachuba

[57] ABSTRACT

An electric shaver with vacuum is provided including a housing having a cutting blade chamber and a divider thereby defining a large compartment in communication with the cutting blade chamber and a small compartment with an open top. Also included is an arcuate lid mounted on the housing for allowing selective access to the small compartment of the housing and further affording a hermetically sealed conduit between the small compartment and the cutting blade chamber. A filter bag is releasably situated within the small compartment of the housing. An air flow mechanism is situated within the small compartment of the housing for affording a suction in the cutting blade chamber to effect the collection of shavings in the filter bag.

7 Claims, 4 Drawing Sheets

ELECTRIC SHAVER WITH VACUUM

BACKGROUND OF THE INVENTION

1. Field of the Invention

The present invention relates to electric shavers and more particularly pertains to a new electric shaver with vacuum for convenient collection and disposal of shavings from within a cutting blade chamber of the electric shaver.

2. Description of the Prior Art

The use of electric shavers is known in the prior art. More specifically, electric shavers heretofore devised and utilized are known to consist basically of familiar, expected and obvious structural configurations, notwithstanding the myriad of designs encompassed by the crowded prior art which have been developed for the fulfillment of countless objectives and requirements.

Known prior art electric shavers include U.S. Pat. No. 4,417,397; U.S. Pat. No. 4,031,618; U.S. Pat. No. 5,289,636; U.S. Pat. No. 5,313,704; U.S. Pat. Des. 358,230; and U.S. Pat. Des. 359,581.

In these respects, the electric shaver with vacuum according to the present invention substantially departs from the conventional concepts and designs of the prior art, and in so doing provides an apparatus primarily developed for the purpose of convenient collection and disposal of shavings from within a cutting blade chamber of the electric shaver.

SUMMARY OF THE INVENTION

In view of the foregoing disadvantages inherent in the known types of electric shavers now present in the prior art, the present invention provides a new electric shaver with vacuum construction wherein the same can be utilized for convenient collection and disposal of shavings from within a cutting blade chamber of the electric shaver.

The general purpose of the present invention, which will be described subsequently in greater detail, is to provide a new electric shaver with vacuum apparatus and method which has many of the advantages of the electric shavers mentioned heretofore and many novel features that result in a new electric shaver with vacuum which is not anticipated, rendered obvious, suggested, or even implied by any of the prior art electric shavers, either alone or in any combination thereof.

To attain this, the present invention generally comprises a housing having a front face, a rear face and a thin periphery formed therebetween. Such periphery of the housing is defined by a top face, a bottom face and a pair of thin side faces. The top face has a cutting blade chamber including a lip integrally coupled to a periphery of the top face of the housing which extends upwardly therefrom. This lip is defined by a pair of side portions which extend along about ¾ a length of the top face. Further, the lip includes a pair of thin end portions with one of the thin end portions having a cut out formed therein adjacent to the top face of the housing. As shown in FIG. 2, the housing further includes a divider mounted between the top face and bottom face thereof. The divider resides in parallel relationship with the side faces of the housing and further in coplanar relationship with the thin end portion of the lip having the cut out formed therein. This divider thus defines a large compartment in communication with the cutting blade chamber and a small compartment with an open top. Also included is an arcuate lid having a horizontal portion with an inboard edge hingably coupled to one of the thin end portions of the lip of the housing. The lid also has a vertical portion with an outboard edge snappily coupled to the housing. In use, the lid functions for allowing selective access to the small compartment of the housing. Further, when closed, the lid affords a hermetically sealed conduit between the small compartment and the cutting blade chamber. A filter bag is provided with a constant horizontal cross-section similar to that of the small compartment of the housing and a height about ½ that of the housing. As shown in FIG. 2, the filter bag includes an open top which is releasably mounted within a recess formed in an upper peripheral edge of the open top of the small compartment. Finally, an air flow assembly is included for affording an air flow through the small compartment and a suction in the cutting blade chamber. This effects the collection of shavings in the filter bag.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new electric shaver with vacuum apparatus and method which has many of the advantages of the electric shavers mentioned heretofore and many novel features that result in a new electric shaver with vacuum which is not anticipated, rendered obvious, suggested, or even implied by any of the prior art electric shavers, either alone or in any combination thereof.

It is another object of the present invention to provide a new electric shaver with vacuum which may be easily and efficiently manufactured and marketed.

It is a further object of the present invention to provide a new electric shaver with vacuum which is of a durable and reliable construction.

An even further object of the present invention is to provide a new electric shaver with vacuum which is susceptible of a low cost of manufacture with regard to both materials and labor, and which accordingly is then susceptible of low prices of sale to the consuming public, thereby making such electric shaver with vacuum economically available to the buying public.

Still yet another object of the present invention is to provide a new electric shaver with vacuum which provides in the apparatuses and methods of the prior art some of the advantages thereof, while simultaneously overcoming some of the disadvantages normally associated therewith.

Still another object of the present invention is to provide a new electric shaver with vacuum for convenient collection and disposal of shavings from within a cutting blade chamber of the electric shaver.

Even still another object of the present invention is to provide a new electric shaver with vacuum that includes a housing having a cutting blade chamber and a divider thereby defining a large compartment in communication with the cutting blade chamber and a small compartment with an open top. Also included is an arcuate lid mounted on the housing for allowing selective access to the small compartment of the housing and further affording a hermetically sealed conduit between the small compartment and the cutting blade chamber. A filter bag is releasably situated within the small compartment of the housing. An air flow mechanism is situated within the small compartment of the housing for affording a suction in the cutting blade chamber to effect the collection of shavings in the filter bag.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
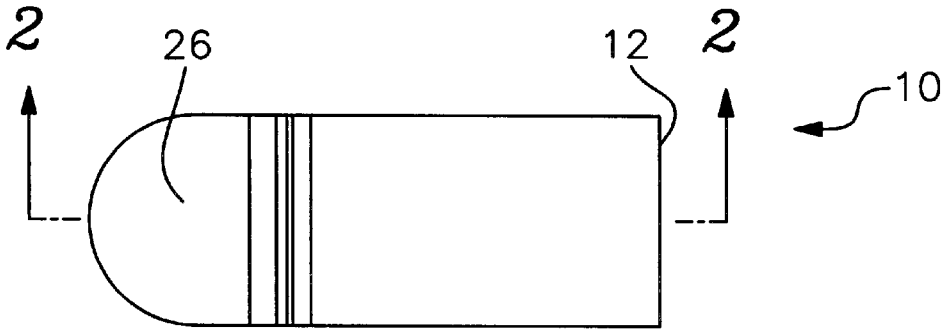
FIG. 1 is a top view of a new electric shaver with vacuum according to the present invention.

With reference now to the drawings, and in particular to FIGS. 1 through 8 thereof, a new electric shaver with vacuum embodying the principles and concepts of the present invention and generally designated by the reference numeral 10 will be described.

The present invention, designated as numeral 10, includes a housing 12 having a front face, a rear face and a thin periphery or side wall 13 formed therebetween. Such periphery of the housing is defined by a top face 15, a bottom face 19 and a pair of thin side faces 21. The top face has a cutting blade chamber 14 including a lip 16 integrally coupled to a periphery 17 of the top face of the housing and extended upwardly therefrom. This lip is defined by a pair of side portions 23 which extend along about ¾ a length of the top face. Further, the lip includes a pair of thin end portions 25 with one of the thin end portions having a cut out 18 formed therein adjacent to the top face of the housing. As is conventional, a screen lines an open top of the cutting blade chamber.

Figure 2:
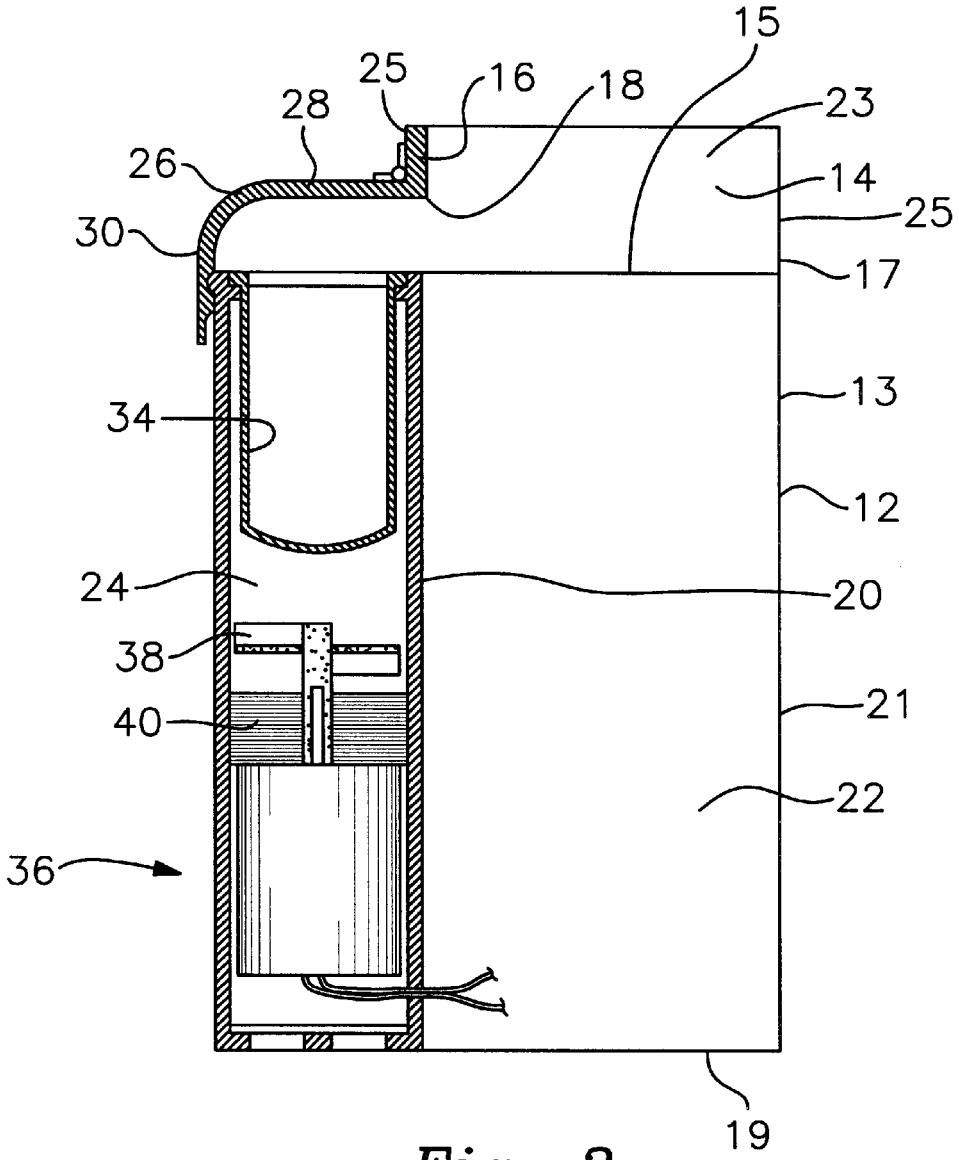
FIG. 2 is a side cross-sectional view of the present invention taken along line 2—2 shown in FIG. 1.
Figure 3:
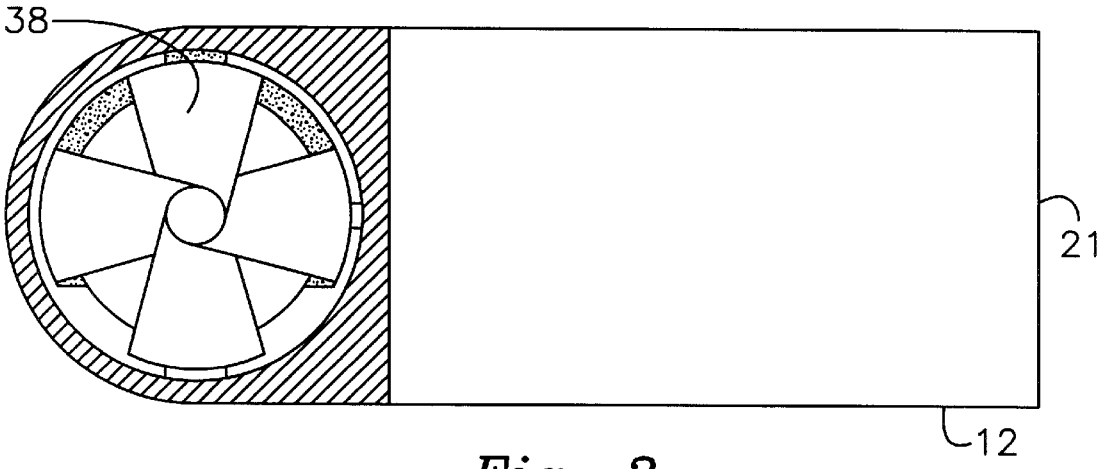
FIG. 3 is a top cross-sectional view of the present invention.
Figure 4:
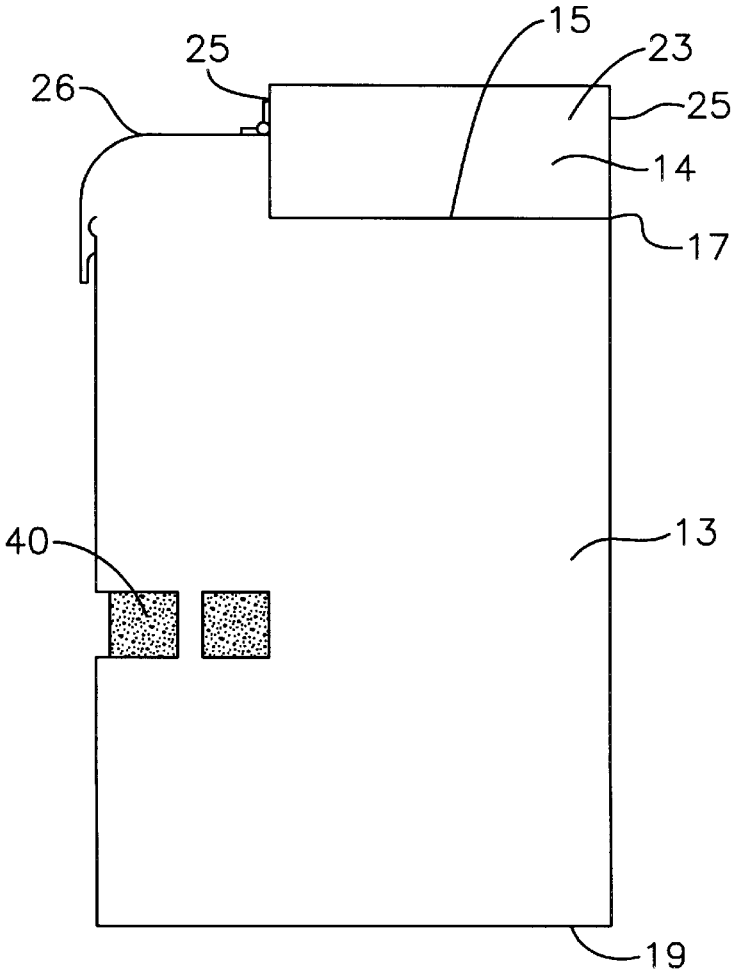
FIG. 4 is a side view of the present invention.
Figure 5:
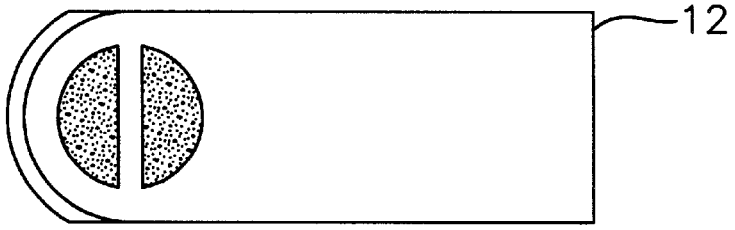
FIG. 5 is a bottom view of the present invention.

As shown in FIG. 2, the housing further includes a divider 20 mounted between the top face and bottom face thereof. The divider resides in parallel relationship with the side faces of the housing and further in coplanar relationship with the thin end portion of the lip having the cut out formed therein. This divider thus defines a large compartment 22 in communication with the cutting blade chamber and a small compartment 24 with an open top.

Also included is an arcuate lid 26 having a horizontal portion 28 with an inboard edge 29 hingably coupled to one of the thin end portions of the lip of the housing. The lid also has a vertical portion 30 with an outboard edge snappily coupled to the housing. When open, the lid allows access to the small compartment of the housing. Further, when closed, the lid affords a hermetically sealed conduit between the small compartment and the cutting blade chamber.

A filter bag 34 is provided with a constant horizontal cross-section similar to that of the small compartment of the housing and a height about ½ that of the housing. As shown in FIG. 2, the filter bag includes an open top which is releasably mounted within a recess formed in an upper peripheral edge of the open top of the small compartment.

Finally, an air flow assembly 36 includes a fan 38 and associated motor situated within the small compartment. As shown in FIG. 2, a pair of openings 40 are formed in the housing just below the fan and above the motor. Such openings are preferably lined with a filter of some sort.

Figure 6:
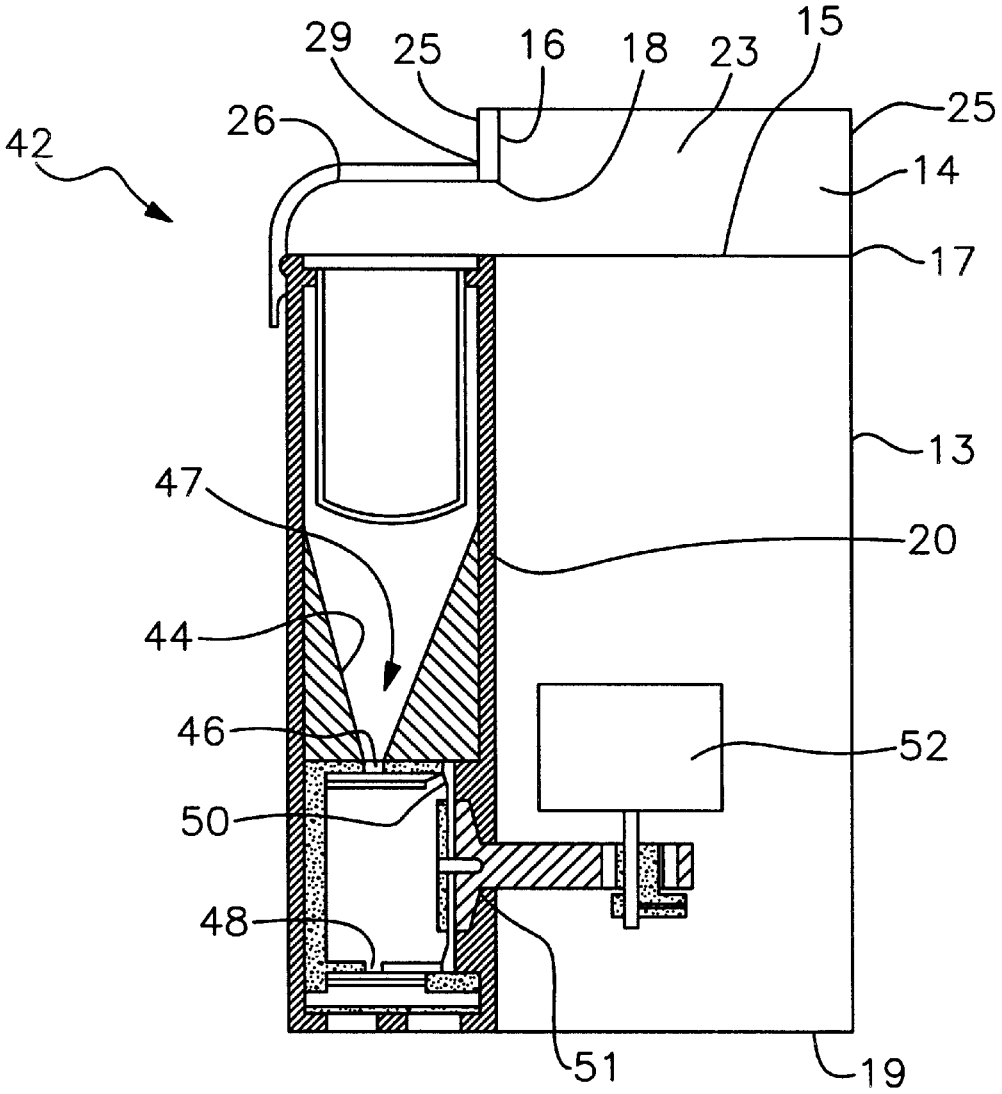
FIG. 6 is a side cross-sectional view of an alternate embodiment of the present invention.
Figure 7:
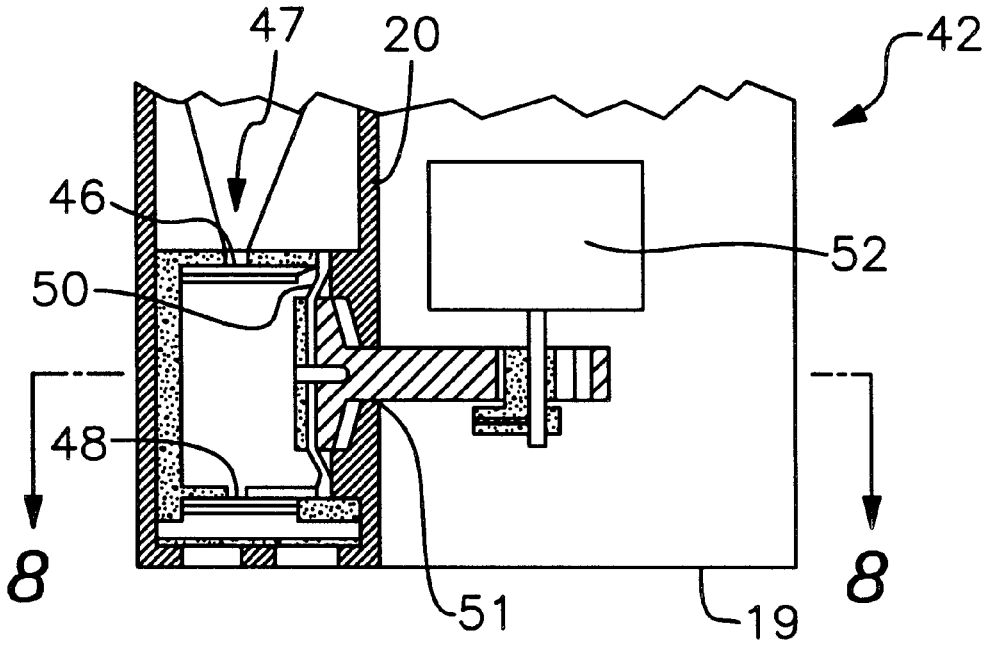
FIG. 7 is a detailed side cross-sectional of the air flow assembly of the alternate embodiment of the present invention.
Figure 8:
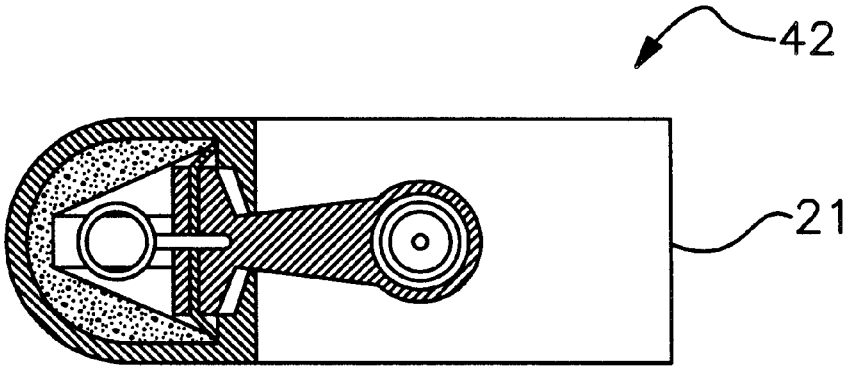
FIG. 8 is a top cross-sectional view of the embodiment of FIG. 7 taken along line 8—8 shown in FIG. 7.

In an alternate embodiment 42, the fan is excluded in favor of a a plurality of components shown in FIGS. 6–8. Such components include an inverted cone-shaped entry channel 44. A first one-way valve 46 is mounted to a lower opening 47 of the entry. Associated therewith is a second one-way valve 48 mounted to a bottom wall of the small compartment adjacent to the bottom face of the housing. The air flow assembly further includes a diaphragm 50 defining a wall of the chamber. Slidably situated through a bore formed in the divider is a piston which has an outboard end 51 connected to the diaphragm. Lastly, a motor 52 is situated within the large compartment of the housing and connected to an inboard end of the piston. The motor functions for cyclically biasing the diaphragm for affording an air flow through the small compartment and a suction in the cutting blade chamber. This effects the collection of shavings in the filter bag. The present invention thus allows convenient collection and disposal of shavings from within a cutting blade chamber of the electric shaver.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An electric shaver with vacuum comprising, in combination:

a housing with a substantially rectangular configuration and including a front face, a rear face and a peripheral side wall formed therebetween defined by a top face, a bottom face and a pair of thin side faces, the top face having a cutting blade chamber including a lip integrally coupled to a periphery of the top face of the housing and extending upwardly therefrom, the lip defined by a pair of side portions which extend along about ¾ a length of the top face and a pair of thin end portions with one of the thin end portions having a cut out formed therein adjacent to the top face of the housing, wherein the housing further includes a divider mounted between the top face and bottom face thereof in parallel relationship with the side faces of the housing and in coplanar relationship with the thin end portion of the lip having the cut out formed therein, the divider thereby defining a large compartment in communication with the cutting blade chamber and a small compartment with an open top;

an arcuate lid having a horizontal portion with an inboard edge hingably coupled to one of the thin end portions of the lip of the housing and a vertical portion with an outboard edge releasably coupled to the housing for allowing selective access to the small compartment of the housing and further affording a hermetically sealed conduit between the small compartment and the cutting blade chamber;

a filter bag having a constant horizontal cross-section similar to that of the small compartment of the housing and a height about ½ that of the housing, the filter bag further including an open top removably mounted within a recess formed in an upper peripheral edge of the open top of the small compartment, wherein the open top of the filter bag remains coincident with the open top of the small compartment; and air flow means for affording a suction in the cutting blade chamber to effect the collection of shavings in the filter bag.

2. An electric shaver with vacuum comprising:

a housing with a substantially rectangular configuration and including a cutting blade chamber and a divider thereby defining a large compartment in communication with the cutting blade chamber and a small compartment with an open top, wherein the housing has a peripheral lip coupled to the housing and extending upwardly therefrom with a cut out formed therein;

a lid hingably mounted to the peripheral lip of the housing above the cut out of the peripheral lip and over the open top of the small compartment for allowing selective access to the small compartment of the housing and further affording a hermetically sealed conduit between the small compartment and the cutting blade chamber;

a filter bag removably positioned within the small compartment of the housing with a top opening coincident with the open top of the small compartment; and air flow means for affording a suction in the cutting blade chamber to effect the collection of shavings in the filter bag.

3. An electric shaver with vacuum as set forth in claim 2 wherein the air flow means includes a fan.

4. An electric shaver with vacuum as set forth in claim 2 wherein the air flow means includes a pump.

5. An electric shaver with vacuum as set forth in claim 2 wherein the cutting blade chamber includes a lip with a cut out formed therein, wherein the lid is hingably coupled to the lip adjacent to the cut out.

6. An electric shaver with vacuum as set forth in claim 1 wherein the air flow means is situated within the small compartment of the housing below the filter bag and includes an inverted cone-shaped entry channel, a first one-way valve mounted to a lower opening of the entry, a second one-way valve mounted to a bottom wall of the small compartment adjacent to the bottom face of the housing, a diaphragm defining a wall of the chamber, a piston having an outboard end slidably situated through a bore formed in the divider and connected to the diaphragm, and a motor situated within the large compartment of the housing and connected to an inboard end of the piston for cyclically biasing the diaphragm for affording an air flow through the small compartment and a suction in the cutting blade chamber to effect the collection of shavings in the filter bag.

7. An electric shaver with vacuum as set forth in claim 1 wherein the air flow means is situated within the small compartment of the housing below the filter bag and includes a motorized fan.

* * * * *